United States Patent [19]

Golding

[11] 4,319,612

[45] Mar. 16, 1982

[54] METHOD OF WASHING AND FILLING CONTAINERS

[75] Inventor: Cyril G. Golding, Sedgley, England

[73] Assignee: GKN Sankey Limited, Telford, United Kingdom

[21] Appl. No.: 147,536

[22] Filed: May 7, 1980

[30] Foreign Application Priority Data

May 12, 1979 [GB] United Kingdom ..... 16582/79

[51] Int. Cl.[3] ..... B65B 3/04

[52] U.S. Cl. ..... 141/1; 141/92

[58] Field of Search ..... 134/22 R, 22 C, 166 R, 134/166 C; 137/238; 141/1, 48, 49, 89–92, 113, 129, 275, 392

[56] References Cited

U.S. PATENT DOCUMENTS 3,907,011 9/1975 Edmunds ..... 141/92

*Primary Examiner*—Frederick R. Schmidt

*Attorney, Agent, or Firm*—Merriam, Marshall & Bicknell

[57] ABSTRACT

A method of washing a keg and filling it with beer which comprises giving the keg first and second washes at first and second washing stations, filling the keg with steam and carbon dioxide at the second washing station after washing and then moving the keg to a filling station and filling the keg with beer at said filling station while allowing the carbon dioxide in the keg to escape through a pressure relief valve.

6 Claims, 5 Drawing Figures

METHOD OF WASHING AND FILLING CONTAINERS

BACKGROUND TO THE INVENTION

This invention relates to a method for washing the interior of containers and filling the containers with liquid, the containers having spring-loaded closure units.

Specifically the invention has been developed for the washing and/or filling of beer kegs. Such a keg has a closure unit which has one or two spring-loaded valve members which act to seal the keg. The closure units are arranged so that the valve members may be opened to fill the keg, or dispense beer from the keg, with the closure unit in place in the keg. Such a keg is filled against a counter-pressure of carbon dioxide and beer is dispensed from a keg under a top pressure of carbon dioxide.

Normally a keg is washed and sterilized in one or two washing stations and is then moved to a filling station where the keg is pressurised with carbon dioxide and beer is then filled into the keg under the top pressure of the carbon dioxide which is displaced from the keg as the beer enters the keg.

The object of the present invention is to provide a method of filling a container, particularly a beer keg, in which the washing is carried out at two stations and in which the times that a keg located at the second washing station and at the filling station are more equal than in methods heretofore used.

A further object of the invention is to provide a method of washing and filling a container or beer keg in which the container or keg may be cooled between the second washing station and the filling station. This is particularly advantageous where the keg has to be filled with highly carbonated beers whose quality would be impaired if filled into a hot keg.

SUMMARY OF THE INVENTION

According to the invention we provide a method of washing the interior of a container and then filling the container with liquid under top pressure of a gas, the method comprising subjecting the interior of the container to a first wash at a first washing station, moving the container to a second washing station, subjecting the interior of the container to a second wash at said second station and then filling the container with steam and gas at said second station, sealing the container, moving the container to a filling station, unsealing and filling the container at said filling station with liquid which displaces said gas through a pressure relief valve and finally sealing the filled container.

By this method, the container is filled with gas at the second washing station thus enabling one to reduce the time the container is at the filling station. Moreover, since the container is filled with gas at the second washing station the container can be cooled between the second washing station and the filling station without forming a vacuum in the container. The method is carried out so that any condensate is ejected by the gas at the filling station before the container is filled.

The method is particularly applicable to the filling of a container with beer wherein the gas is carbon dioxide.

BRIEF DESCRIPTION OF THE DRAWINGS

The invention will now be described in detail by way of example with reference to the accompanying drawings in which.

DESCRIPTION OF PREFERRED EMBODIMENTS

Figure 1:
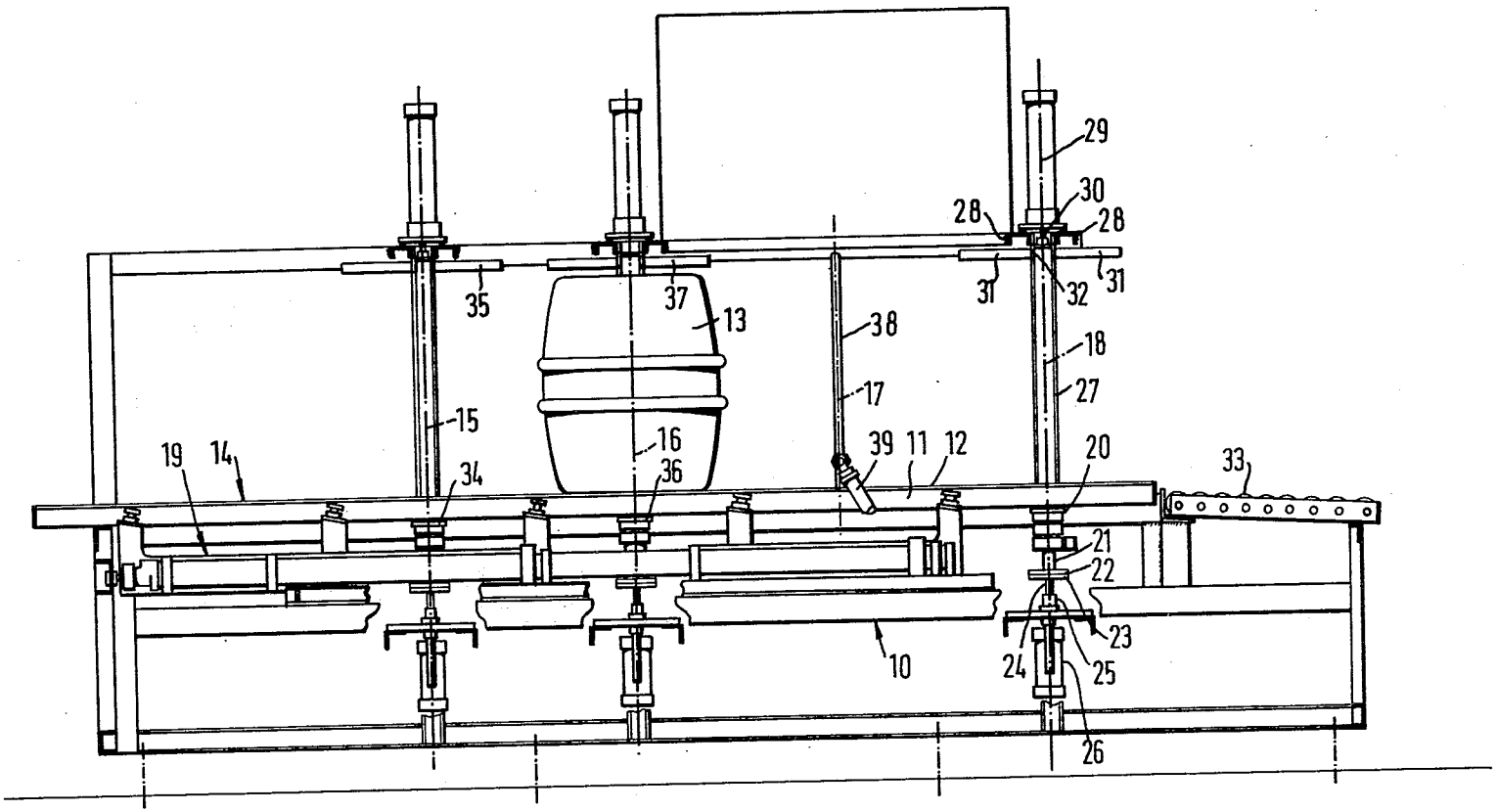
FIG. 1 is a side elevation of a washing and filling machine for beer kegs on which the method may be carried out.
Figure 2:
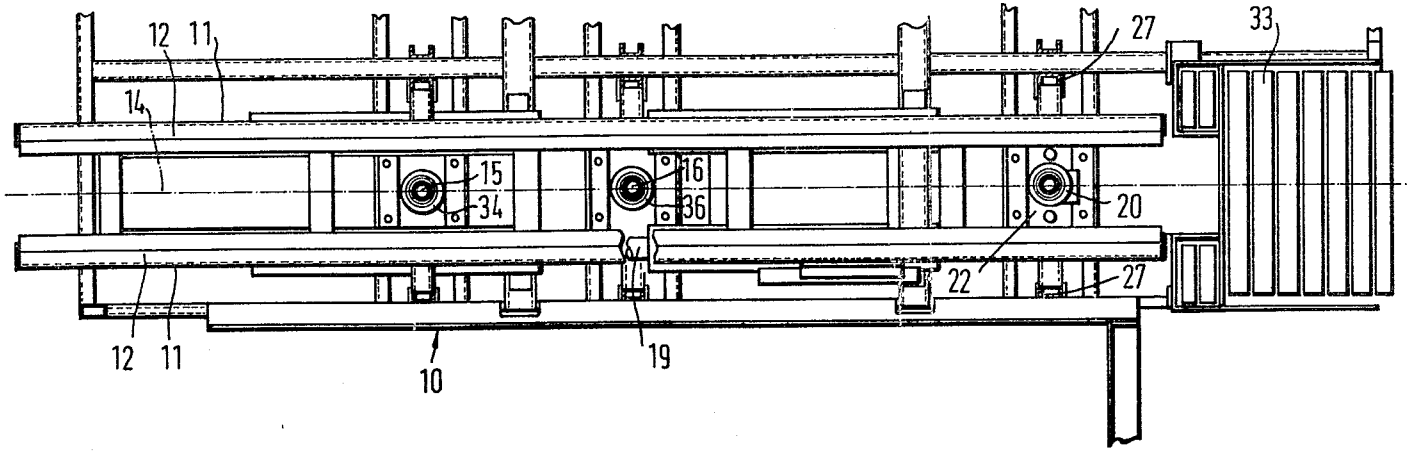
FIG. 2 is a section of the machine of FIG. 1 on the line A—A.

Referring to FIGS. 1 and 2, the machine has a main frame indicated generally at 10. The frame carries an apertured track consisting of two rails 11 having horizontal flanges 12 which provide horizontal supporting surfaces for a container such as is shown at 13.

Spaced along the track are a number of stations, thus there is a waiting station 14, a first washing station the centre line of which is shown at 15, a second washing station the centre line of which is shown at 16, a waiting/cooling station whose centre line is shown at 17 and a filling or racking station whose centre line is shown at 18. Means, indicated generally at 19 is provided for moving containers between the stations, these moving means form no part of the present invention.

At each of the washing stations and at the filling or racking station there is a head to engage a container whereby the latter can be washed or filled and there is also clamping means for the container as will now be described.

The means for moving each of the heads is similar and it will be described in relation to the head at the filling or racking station 18. This head is indicated at 20 and includes a cylinder 21 within which is mounted a piston, not shown, for moving a probe, also not shown, within the head to open the closure unit of a container engaged with the head. The lower end of the cylinder is secured to a mounting plate 22 which in turn is secured to a bridge piece 23. The bridge piece is connected to two vertical guide rods, one of which is shown at 24 and each guide rod slides in a bush 25 secured to the main frame. The bridge piece 23 is also connected to the piston rod of a pneumatic ram 26, the cylinder of which is secured to the main frame.

The head 20 is shown in its lower position below the flanges 12; the ram 26 can be operated to move the head to an upper position in which it is above the surfaces 12. When a container has its neck engaged by the head 20 and the latter is moved to its upper position it will lift the container from the flanges 12 on which it has been resting.

Extending upwardly from the apertured track on the centre line 18 of the filling and racking station is a pair of channel guides 27, the channels of which face inwardly as is clear from FIG. 2. The main frame is extended by these guides and with other uprights and has cross members 28 in its upper part which support a pneumatic ram 29. The piston rod 30 of the ram 29 is connected to a cruciform member having opposite arms 31 and a further pair of opposite arms, one of which is shown at 32, the ends of the arms 32 being guided within the channels 27.

The operation of filling at the station 18 is as follows- a container such as 13 is moved by the moving means 19 until it is in alignment with the head member 20, the latter at this stage being in its lower position as shown. The head 20 is now raised by the ram 26 and lifts the container off the flanges 12. The cruciform member 31, 32 is now moved down by the ram 29 to engage the bottom of the container which is uppermost. The fluid pressure applied to the ram 29 is greater than that applied to the ram 26 so that the container is forced downwardly by the ram 29 until it rests on the flanges 12. It will be appreciated that the fluid pressure of the ram 26 has been overcome by that of the ram 29. The sealing pressure between the head 20 and the container is that exerted by the ram 26.

The container is now filled and during filling the weight of the container and its contents is taken on the flanges 12 rather than on the head 20. After filling is completed, the head 20 is retracted by the ram 26 and the cruciform member 31, 32 is also retracted, the container can then be moved by the moving means 19 onto the outlet conveyor 33.

The operation of the machine at the first washing station 15 is as described above for the racking station except that the head 34 and the cruciform member 35 clamp the keg while washing is carried out via the head 34. As with the racking head the keg is clamped against the rails 12 by the cruciform member 35. Similarly, at the second washing station the keg is washed via a head 36 while clamped against the flanges by a cruciform member 37. The means for moving the cruciform members 35 and 37 are the same as that described in relation to the cruciform member 31, 32 and the means for moving the head 34 and 36 are the same as the means for moving the heads 20.

It will be appreciated that the moving means 19 move the kegs between the stations while the kegs are resting on the flanges 12 so that at all times except when the kegs are lifted by the heads the weight of the kegs is taken by the flanges 12.

If desired, a keg having left the second washing station 16 can be cooled by a water spray before moving to the racking or filling station 18. The water spray comprises a pipe 38 of inverted U-shape which is fed with cooling water via a conduit 39 and has inwardly facing nozzles directed to spray water on a keg at the station 17.

Figure 3:
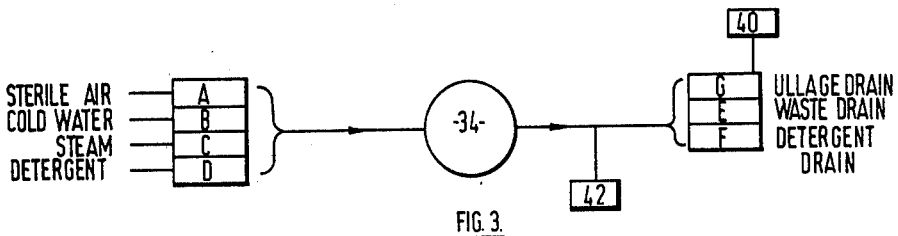
FIG. 3 is a diagram showing the services to the first washing station.

The operations of washing and filling at the stations 15, 16 and 18 will now be described in relation to FIGS. 3 to 5. FIG. 3 shows the services connected to the head 34 at the first washing station. Each of the blocks labelled A to G represents a pneumatically operated valve controlled from a central control system and controlling the service marked against it.

After the keg closure unit has been sealingly clamped against the head 34, the operating cycle will be as follows:

1. The system will be tested for leaks, all the valves will be closed except valve A which will be open and any drop in pressure will be monitored; the probe is then extended to open the closure unit.

2. Valves A and G are opened to dispel any old beer, known as ullage, which may have remained in the keg. Valves A and G are left open for a pre-determined time, typically four seconds, and a conductivity probe 40 associated with the ullage drain senses when ullage flow has ceased.

3. The interior of the keg will now be washed with cold water with air injection and valves A, B and E will be opened so that the cold water after having passed through the keg will pass to the waste drain.

4. The keg will then be steamed and valves C and E will be opened.

5. The keg will now be washed with hot detergent with air injection and valves A, D and F will be open, the detergent being discharged to a detergent drain.

6. The keg will then be steamed to discharge the detergent and the valves C, and F will be open.

7. Valve C is closed and the probe is withdrawn whilst valve F is left open for a pre-determined time, typically one second, in order to allow residual steam pressure within the pipework to be dissipated. At each step all the valves except those mentioned will be closed.

It should be noted that a temperature probe 42 is associated with the manifold housing valves E, F and G. The temperature is monitored during the sequences described above particularly with a view to ensuring that the fluids admitted and discharged after the steam and detergent discharge cycles (sequences 4 and 6) have achieved a sufficiently high temperature to be effective.

Figure 4:
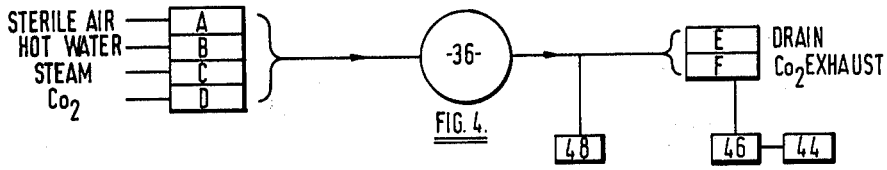
FIG. 4 is a diagram showing the services to the second washing station.

The keg will then be moved to the second washing station 16 and the services connected to the head 36 of the second washing station as shown in FIG. 4. As before the blocks A to F represent valves which are operated from a central control system, in this case valve F is associated with a conductivity probe 44 and a pressure relief valve 46. After the keg closure unit has been sealingly clamped against the head 36 the cycle of operation will be as follows; it being understood that all the valves not mentioned as being open will be closed: The cycle of operation is as follows:

1. Test as before with only the valve A open to test the system for leakage; the probe is then extended to open the closure unit.

2. Hot water wash with air injection, valves A, B, and E being open.

3. The keg will then be steamed to eject the water, the valves C and E being open.

4. The keg will then be filled with steam with the valve C being open but all the other valves closed.

5. The keg will then be filled with $Co_2$ with the valves D and F being open, the pressure relief valve 46 associated with valve F controlling the pressure of the $Co_2$ in the keg. The conductivity probe 44 also associated with valve F is used to check that no liquid is present.

6. Valves D and E are then closed and the probe is withdrawn to seal the keg containing steam and $Co_2$. Before the head 36 is unsealed from the keg the valve E is opened momentarily to equalise the $CO_2$ pressure in the pipework to atmosphere.

As before, a temperature probe 48 is associated with the manifold housing valves E and F in order that the temperature may be monitored during the steam injection sequences 3 and 4.

At the end of the operation at the washing station the keg will therefore be filled with steam and $Co_2$ for example, the steam may be at a temperature of 140° C. and the $Co_2$ at a pressure of 50 psi. It will be appreciated that after the keg has been filled with steam and $Co_2$ it will have been sealed by the withdrawal of the probe and will then pass to the station 17. Here the keg will wait until passing to the racking and filling station 18. The time that the keg is at the station 17 may be used either to increase the sterilisation time, the keg being sterilized by the steam it contains and the gas in the keg also being sterilised by virtue of the fact that it is at a temperature in excess of 100° C. or, alternatively, the keg may be cooled by being sprayed with water from the pipe 38 as described above. This is particularly useful if the keg is to be filled with highly carbonated beer at the filling or racking station. If the keg is cooled the steam will, of course, condense and the $Co_2$ will be cooled but the pressure at which the $Co_2$ is filled into the keg at the second washing station will be such as to ensure that a vacuum is not formed within the keg at the station 17 even if cooling is effected at that station.

Figure 5:
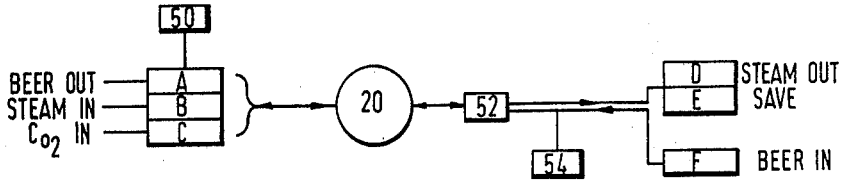
FIG. 5 is a diagram showing the services at the filling or racking station.

The keg then passes to the racking or filling station 18 and the services are shown at FIG. 5 and as before the blocks A-F inclusive are valves operated from a central control system, in this instance valve A is associated with a pressure relief valve 50. The lines from valves D, E and F are connected to the head 20 via a changeover valve 52, the operation of which is more particularly described in our copending British Patent Application 7916585 of even date.

The cycle of operations at the filling station via the head 20 will be as follows:

1. Test, the valve C will be open with all the other valves closed and $Co_2$ will be applied to the head to ensure that there is no leakage.

2. The head 20 will be sterilized by having steam passed through it and the valves B and D open. This steaming will be effected with the keg closure unit still closed.

3. The probe is then inserted into the keg with valve A open to allow the residual $CO_2$ pressure in the keg to decay to the pressure value set on the pressure relief valve 50 and to expel any condensate from the keg.

4. The changeover valve 52 is then operated to connect the "beer in" line to the keg. Valves A and F are opened and beer is filled into the keg against the pressure of the $CO_2$ which will be expelled during beer filling; the pressure in the keg being maintained by the pressure relief valve 50.

5. After filling is complete valve F is closed and the changeover valve 52 is switched to connect the "steam out" and "save" lines to the keg. Valve A is left open for a pre-determined time to allow any over-pressure in the keg to decay via the pressure relief valve 50 associated with valve A. Valve A is then closed and the probe is withdrawn to close the closure unit.

6. After the above filling sequences, valves C and E are opened so that $CO_2$ will drive residual beer in the system between valve A and head 20 to a beer save tank after which the head 20 is released from its sealing engagement with the keg.

A pressure sensor 54 is connected into the line between beer inlet valve F and the changeover valve 52 to detect any variation from a predetermined pressure setting. Any such variation would indicate a malfunction either in valve F or changeover valve 52 and the operating cycle may then be stopped during any of the above sequences, except sequence 4 during which there will be some pressure variation in the line during filling of beer into the keg. During the other sequences the line between valves F and 52 is closed at each end and the pressure therein should therefore remain constant.

It will be seen that the keg is pressurised with $Co_2$ at the second washing station, this enables the time spent by the keg at the filling station to be cut down since the keg is already pressurised. Secondly, the keg may be cooled between the second washing station and the filling station without a vacuum developing therein because the keg is filled with $Co_2$. The partial pressure of the $Co_2$ will be such, as mentioned above, as to ensure that a vacuum is not formed within the keg during cooling. Also condensate formed in the keg will be blown out before filling starts.

If desired an extra waiting station may be provided intermediate the second wash station 16 and the cooling station 17 in order to increase the time of sterilisation when the keg contains steam and $CO_2$. Also, one or more additional washing stations may be provided prior to the first and second washing stations described herein. Furthermore, additional filling heads may be provided on the machine.

I claim:

1. A method of washing the interior of a container and then filling the container with liquid under top pressure of a gas, characterized by the steps of subjecting the interior of the container to a first wash at a first washing station; moving the container to a second washing station, subjecting the interior of the container to a second wash at said second station and then filling the container with steam and gas at said second station, and sealing the container; and moving the container to a filling station, unsealing and filling the container at said filling station with liquid which displaces said gas through a pressure relief valve, and finally sealing the filled container.

2. A method according to claim 1 wherein the container is cooled between the second washing station and the filling station.

3. A method according to claim 1 wherein the container is passed from the second washing station to a waiting station, at which sterilization is continued by the steam within the container, before it is moved to the filling station.

4. A method according to claim 1 wherein at the filling station and prior to filling, the gas in the container is used to drive out any condensate therein.

5. A method according to claim 1 wherein the liquid is beer and the gas is carbon dioxide.

6. A method according to claim 1 wherein the gas within the container is maintained at a temperature in excess of 100° C. for a predetermined time after the container is moved from said second washing station whereby sterilization of the gas in the container is effected.

* * * * *